US008603429B2

(12) United States Patent
Samejima

(10) Patent No.: US 8,603,429 B2
(45) Date of Patent: Dec. 10, 2013

(54) PRODUCTION SYSTEM AND PRODUCTION METHOD FOR CARBON FIBER THREAD

(75) Inventor: Tadao Samejima, Toyohashi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 378 days.

(21) Appl. No.: 12/988,392

(22) PCT Filed: Apr. 17, 2009

(86) PCT No.: PCT/JP2009/057787

§ 371 (c)(1),
(2), (4) Date: Oct. 18, 2010

(87) PCT Pub. No.: WO2009/128541

PCT Pub. Date: Oct. 22, 2009

(65) Prior Publication Data

US 2011/0033364 A1 Feb. 10, 2011

(30) Foreign Application Priority Data

Apr. 18, 2008 (JP) ..... 2008-108970

(51) Int. Cl.
*D01F 9/12* (2006.01)

(52) U.S. Cl.
USPC ..... 423/447.1; 264/29.2

(58) Field of Classification Search
USPC ..... 264/29.2; 423/447.1
See application file for complete search history.

(56) References Cited

U.S. PATENT DOCUMENTS

| | | | |
|---|---|---|---|
| 4,335,089 | A | 6/1982 | Maruyama et al. |
| 6,485,592 | B1 | 11/2002 | Yoshimura et al. |
| 2004/0168425 | A1 | 9/2004 | Kawamura et al. |

FOREIGN PATENT DOCUMENTS

| | | | | |
|---|---|---|---|---|
| EP | 0 909 842 | A1 | 4/1999 | |
| EP | 1 420 091 | A1 | 5/2004 | |
| JP | 5323411 | * | 7/1978 | ..... D01F 9/12 |
| JP | 6 308053 | | 11/1994 | |
| JP | 10 226918 | | 8/1998 | |
| JP | 11 131348 | | 5/1999 | |
| JP | 2000 144534 | | 5/2000 | |
| JP | 2000 281379 | | 10/2000 | |
| JP | 2002 302341 | | 10/2002 | |
| JP | 2004 76174 | | 3/2004 | |
| WO | 2006 089438 | | 8/2006 | |

OTHER PUBLICATIONS

International Search Report issued Jun. 9, 2009 in PCT/JP09/057787 filed Apr. 17, 2009.
Extended European Search Report issued Dec. 7, 2011 in patent application No. 09731530.3.

* cited by examiner

*Primary Examiner* — Stuart Hendrickson
(74) *Attorney, Agent, or Firm* — Oblon, Spivak, McClelland, Maier & Neustadt, L.L.P.

(57) ABSTRACT

Disclosed is a production system (1) for a carbon fiber thread (Z) by continuously subjecting a carbon fiber thread precursor (X) having a jointed portion (a) connecting respective ends of two carbon fiber thread precursors (X) to heat treatment, which contains an oxidization oven (10) for subjecting the carbon fiber thread precursor (X) to an oxidization treatment, a carbonization furnace (12) for subjecting a thus obtained oxidized fiber thread to a carbonization treatment, a winder (18) for winding the carbon fiber thread (Z) around a winding bobbin, a detection means (24) for detecting the jointed portion (a), a positional information-acquisition means (26) for acquiring positional information of the jointed portion (a), a control means (28) for controlling the winder (18) in such a way that a carbon fiber thread including the jointed portion (a) and a carbon fiber thread not including the jointed portion (a) are separately wound up around different winding bobbins based on the positional information. Also disclosed is a production method for a carbon fiber thread by use of the production system (1).

13 Claims, 2 Drawing Sheets

PRODUCTION SYSTEM AND PRODUCTION METHOD FOR CARBON FIBER THREAD

TECHNICAL FIELD

The present invention relates to a production system and a production method for a carbon fiber thread.

The present application claims the priority of Japanese Patent Application No. 2008-108,970 filed on Apr. 18, 2008, the contents of which are incorporated herein by reference.

BACKGROUND ART

A carbon fiber thread is generally produced by subjecting a carbon fiber thread precursor such as an acrylic fiber thread to an oxidization treatment at 200 to 300° C. under an oxidizing atmosphere to obtain an oxidized fiber thread followed by subjecting the oxidized fiber thread thus obtained to a carbonization treatment at 1,000° C. under an inert atmosphere. Such a carbon fiber thread has various excellent physical properties, so that it is widely used as a reinforcing fiber for various fiber reinforced composite materials, and a demand for it has been rapidly increased in recent years because it has been used in industry such as buildings, public works, and energy related fields besides the uses in airplanes and sport goods. Therefore, supply of the carbon fiber thread at lower cost is highly desired.

As a method for obtaining a carbon fiber thread at low cost, for example, a method is known in which a plurality of carbon fiber thread precursors wound up around bobbins or folded and piled up in boxes are continuously subjected to heat treatment (an oxidization treatment and a carbonization treatment) with an end of one precursor being connected to an end of another precursor. However, in this method, a jointed portion connecting respective ends of two carbon fiber thread precursors easily causes breakage of fibers by heat accumulation and so on while being subjected to heat treatment as compared with other portions. Therefore, the jointed portion is previously subjected to an oxidization treatment before heat treatment so as to prevent the breakage of fibers.

Specifically, a method is described in Patent Document 1, in which a back end of a preceding carbon fiber thread precursor and a front end of a succeeding carbon fiber thread precursor are connected by use of a fiber thread previously subjected to an oxidization treatment. In addition, a method is described in Patent Documents 2 and 3, in which two carbon fiber thread precursors each having at least one of a back end and a front end subjected to an oxidization treatment are connected. In addition, a method is described in Patent Document 4, in which, to detect a defect existing in a fiber thread bundle, a passing fiber thread is bent with a guide roller having a small radius of curvature and thereby the defect is caused to stick out from an outer circumference of the fiber thread bundle, and thus the portion stuck out is detected by an optical detection device.

PRIOR ART REFERENCES

Patent Documents

Patent Document 1: Japanese Patent Application Laid-Open No. Hei 10-226,918

Patent Document 2: Japanese Patent Application Laid-Open No. 2000-144,534

Patent Document 3: Japanese Patent Application Laid-Open No. 2002-302,341

Patent Document 4: Japanese Patent Application Laid-Open No. Hei 6-308,053

SUMMARY OF THE INVENTION

Problem to be Solved by the Invention

However, according to the methods of Patent Documents 1 to 3, strength of the jointed portion and its surroundings of the carbon fiber thread thus obtained is lower than strength of other portions. Therefore, it is necessary to take off the jointed portion when the carbon fiber thread obtained is wound up around a product bobbin. Conventionally, a jointed portion in a carbon fiber thread was taken off through a visual inspection, but there was a case where a jointed portion was mixed in a product owing to mal-detection or non-detection caused by fluff or thickness unevenness, and hence quality maintenance was difficult and it was difficult to improve operability. Consequently, a method is desired which can improve operability and cost, and also which can produce a high quality carbon fiber thread stably. In addition, according to the method of Patent Document 4, a fiber thread is bent with a guide roller having a small radius of curvature so as to cause a defect to stick out from an outer circumference of the fiber thread bundle, and thereby entwinement of a filament is induced as the defect passes the roller, and hence it needs labor to remove the entwinement or it is needed to stop the operation when the entwinement has advanced.

Accordingly, objects of the present invention are to provide a production system and a production method for a carbon fiber thread, which can prevent degradation of quality caused by mixing of a jointed portion with a high operability and a low cost.

Means for Solving the Problem

The production system of the present invention is a production system for a carbon fiber thread by continuously subjecting a carbon fiber thread precursor having a jointed portion connecting respective ends of two carbon fiber thread precursors to heat treatment, which comprises an oxidization oven for subjecting the carbon fiber thread precursor to an oxidization treatment to obtain an oxidized fiber thread, a carbonization furnace for subjecting the oxidized fiber thread to a carbonization treatment to obtain a carbon fiber thread, a plurality of winder bobbins, a cutting means for cutting the carbon fiber thread, a winder having a switchover mechanism for winding each carbon fiber thread cut by the cutting means around a different winding bobbin, a detection means for detecting the jointed portion by a difference in thickness between the jointed portion and other portions, a positional information-acquisition means for acquiring positional information of the jointed portion located between the detection means and the winder, and a control means for controlling the winder in such a way that a carbon fiber thread including the jointed portion and a carbon fiber thread not including the jointed portion, both being made by cutting, are separately wound up around different winding bobbins based on the positional information.

In addition, the production method for a carbon fiber thread of the present invention is a production method for a carbon fiber thread by continuously subjecting a carbon fiber thread precursor having a jointed portion connecting respective ends of two carbon fiber thread precursors to heat treatment, which comprises: a step (1) of detecting the jointed portion by a difference in thickness between the jointed portion and other portions; a step (2) of subjecting the carbon fiber thread precursor to heat treatment to obtain a carbon fiber thread; a step (3) of acquiring positional information concerning a position where the jointed portion is located between a position where the jointed portion has been detected and a position where the carbon fiber thread is wound up; a step (4) of cutting the carbon fiber thread before and after the jointed portion based on the positional information; and a step (5) of winding separately a carbon fiber thread including the jointed portion and a carbon fiber thread not including the jointed portion, both being made by the cutting.

Effect of the Invention

According to the production system for a carbon fiber thread of the present invention, it is possible to prevent degradation of quality caused by mixing of a jointed portion with a high operability and a low cost. In addition, according to the production method for a carbon fiber thread of the present invention, it is possible to obtain a carbon fiber thread with a high operability and a low cost while preventing degradation of quality caused by mixing of a jointed portion.

BEST MODE FOR CARRYING OUT THE INVENTION

<Production System>

Figure 1:
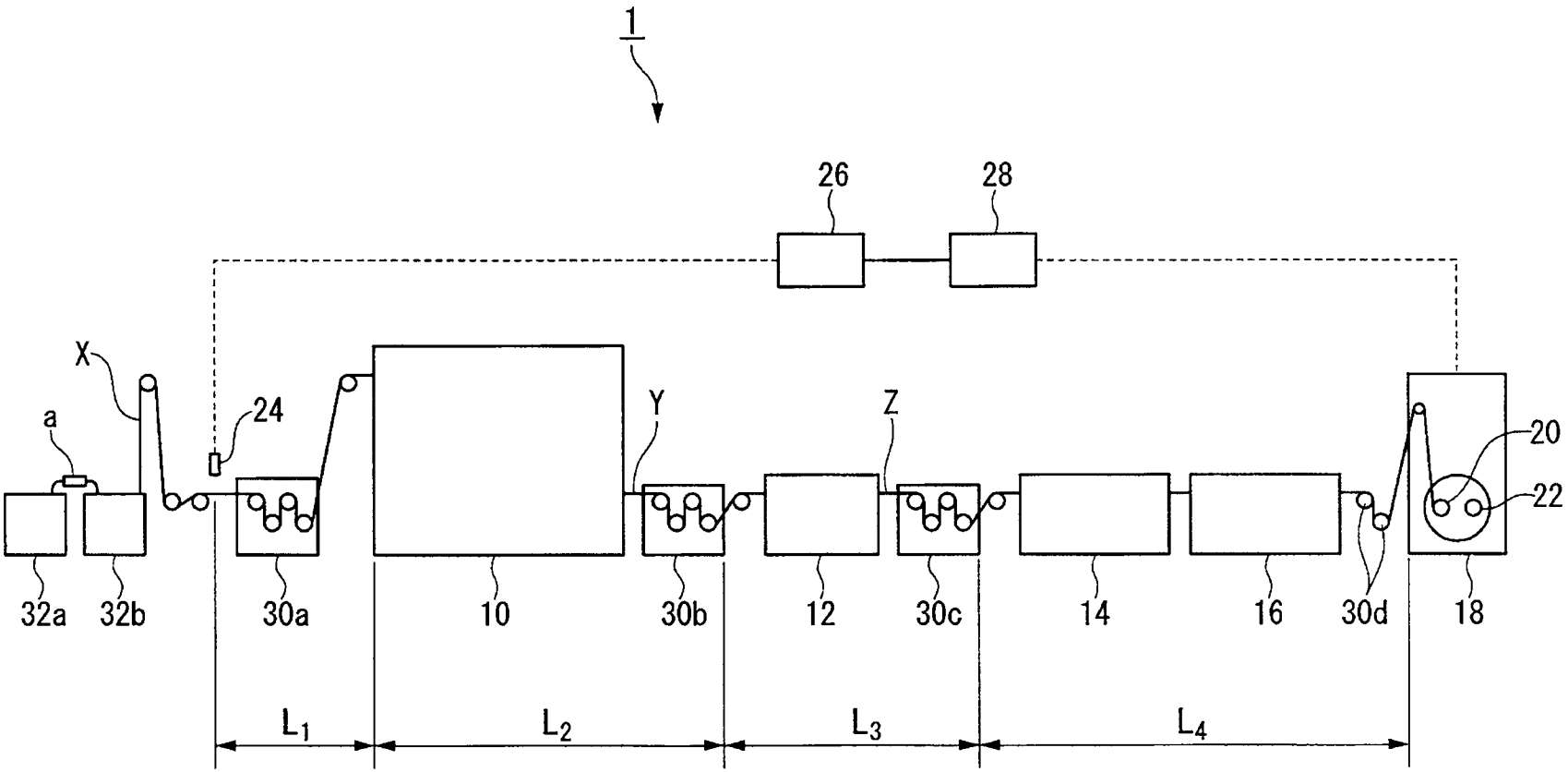
FIG. 1: A schematic constitution diagram showing one embodiment of the production system for a carbon fiber thread of the present invention.

FIG. 1 is a schematic constitution diagram showing one embodiment of the production system for a carbon fiber thread of the present invention. A production system (1) of the present embodiment is a system for a carbon fiber thread (Z) by continuously subjecting a carbon fiber thread precursor (X) having a jointed portion (a) connecting respective ends of two carbon fiber thread precursors (X) to heat treatment. Note that "subjecting the carbon fiber thread precursor to heat treatment" means subjecting the carbon fiber thread precursor to an oxidization treatment and a carbonization treatment.

As shown in FIG. 1, the production system (1) contains an oxidization oven (10) for subjecting the carbon fiber thread precursor (X) to an oxidization treatment to obtain an oxidized fiber thread (Y), a carbonization furnace (12) for subjecting the oxidized fiber thread (Y) to a carbonization treatment to obtain a carbon fiber thread (Z), a surface treatment device (14) for subjecting the carbon fiber thread (Z) to a surface treatment, a sizing treatment device (16) for imparting a sizing agent to the carbon fiber thread (Z), a plurality of winder bobbins, a cutting means for cutting the carbon fiber thread (Z), a winder (18) having a switchover mechanism for winding each carbon fiber thread (Z) cut by the cutting means around a different winding bobbin, a detection means (24) for detecting the jointed portion (a), a positional information-acquisition means (26) for acquiring positional information of the jointed portion (a) located between the detection means (24) and the winder (18), a control means (28) for controlling the winder (18) in such a way that a carbon fiber thread (Z) including the jointed portion (a) and a carbon fiber thread (Z) not including the jointed portion (a), both being made by cutting, are separately wound up around different winding bobbins based on the positional information. In addition, the production system (1) contains transfer rolls (30*a*), (30*b*), (30*c*), and (30*d*) for transferring the carbon fiber thread precursor (X), the oxidized fiber thread (Y), and the carbon fiber thread (Z). In addition, the carbon fiber thread precursor (X) is supplied from supply boxes (32*a*) and (32*b*).

In addition, there is a case where the carbon fiber thread precursor (X), the oxidized fiber thread (Y), and the carbon fiber thread (Z) are collectively called as fiber threads in the present description.

The oxidization oven (10) is an oven for obtaining the oxidized fiber thread (Y) by subjecting the carbon fiber thread precursor (X) to an oxidization treatment by heating under an oxidizing atmosphere. The oxidization oven (10) is not critical as long as it can make the carbon fiber thread precursor (X) oxidized, and a conventional oxidization oven to be used in production of a carbon fiber thread can be used. The oxidization oven (10) may be a single oven or a connection of a plurality of oxidization ovens.

The carbonization furnace (12) is a furnace for obtaining the carbon fiber thread (Z) by subjecting the oxidized fiber thread (Y) obtained by the oxidization treatment to a carbonization treatment by heating under an inert atmosphere. The carbonization furnace (12) is not critical as long as it can make the oxidized fiber thread (Y) carbonized, and a conventional carbonization furnace to be used in production of a carbon fiber thread can be used. The carbonization furnace may be a single furnace or a connection of a plurality of carbonization furnaces.

The surface treatment device (14) is a device for subjecting the carbon fiber thread (Z) to a surface treatment so as to improve adhesion between the carbon fiber thread (Z) and a resin such as epoxy resin. Examples of the surface treatment device (14) include a device using a dry method such as ozone oxidation and a device using a wet method, namely, an electrolytic treatment in an electrolyte.

The sizing treatment device (16) is a device for imparting a sizing agent to the carbon fiber thread (Z) subjected to the surface treatment. The sizing treatment device (16) is not critical as long as it can impart a sizing agent to the carbon fiber thread (Z). Handling property and affinity to fiber-reinforced resins of the carbon fiber thread (Z) are improved by impartation of the sizing agent.

The sizing agent is not critical as long as it can give desired characteristics and examples thereof include sizing agents each containing epoxy resin, polyether resin, epoxy-modified polyurethane resin, or polyester resin as a main component.

The winder (18) is a machine for winding up the carbon fiber thread (Z) and has a plurality of winding bobbins, a cutting means for cutting the carbon fiber thread (Z), and a switchover mechanism for winding each carbon fiber thread (Z) cut by the cutting means around a different winding bobbin. In the embodiment in FIG. 1, the winder (18) has a product-winding bobbin (20) and a jointed portion-winding bobbin (22) as winding bobbins.

In addition, the cutting means (not shown in the figure) is not critical as long as it can cut the carbon fiber thread (Z).

In addition, the switchover mechanism is not critical as long as it can wind up the carbon fiber thread (Z) around a desired winding bobbin.

The winder (18) is not critical as long as it can cut the carbon fiber thread (Z) at a desired position by the cutting means, and as long as it can wind up a carbon fiber thread (Z) not including the jointed portion (a) around the product-winding bobbin (20) and can wind up a carbon fiber thread (Z) including the jointed portion (a) around the jointed portion-winding bobbin (22) by the switchover mechanism, and examples thereof include an automatic switchover turret winder.

The detection means (24) is a means for detecting the jointed portion (a) by a difference in thickness between the jointed portion (a) and other portions. The detection means (24) is not critical as long as it can detect the jointed portion (a) by a difference in thickness, and examples thereof include contact-type detection means such as linear gauge (contact-type displacement sensor), non-contact type detection means such as ultrasonic, laser, radioactive ray, light, and air.

As a specific example of the detection means (24), for example, LJ-G080 (a laser displacement sensor, manufactured by Keyence Corporation) can be recited, and this enables to collectively monitor a plurality of fiber thread bundles running side by side with a single detection means and to find out to which bundle a jointed portion belongs by simultaneously detecting a position of the jointed portion in a direction where fiber thread bundles are placed side by side and a thickness at the jointed portion.

The positional information-acquisition means (26) is a means for acquiring positional information of the jointed portion (a) located between the detection means (24) and the winder (18). The positional information-acquisition means (26) is not critical as long as it can acquire positional information of the jointed portion (a), and examples thereof include a means for calculating a position of the jointed portion a from a distance L that a fiber thread has run between the detection means (24) and the winder (18) and from a running velocity of the fiber thread. Further, when the detection means (24) is arranged just before the winder (18), calculation can be omitted.

Hereinafter, a means for acquiring a position of the jointed portion (a) between the detection means (24) and the winder (18) by calculation will be shown as an example, but the positional information-acquisition means (26) is not limited to this example.

As shown in FIG. 1, L1 (m) is taken as a distance that a fiber thread has run from the detection means (24) to just before the oxidization oven (10), L2 (m) is taken as a distance that the fiber thread has run from the oxidization oven (10) to the transfer roll (30*b*), L3 (m) is taken as a distance that the fiber thread has run from just after the transfer roll (30*b*) to the transfer roll (30*c*), and L4 (m) is taken as a distance that the fiber thread has run from just after the transfer roll (30*c*) to the winder (18). In addition, V1 (m/min) is taken as a transfer velocity of the fiber thread by the transfer roll (30*a*), V2 (m/min) is taken as a transfer velocity of the fiber thread by the transfer roll (30*b*), V3 (m/min) is taken as a transfer velocity of the fiber thread by the transfer roll (30*c*), and V4 (m/min) is taken as a transfer velocity of the fiber thread by the transfer roll (30*d*).

Running time T (min) of the fiber thread during which it has run from the detection means (24) to the winder (18) is calculated from the following equation:

$$T=T1+T2+T3+T4$$

wherein T1 (min) represents a running time of the fiber thread during which the fiber thread has run from the detection means (24) to just before the oxidization oven (10) (T1=L1/N1), T2 (min) represents a running time of the fiber thread during which the fiber thread has run from the oxidization oven (10) to the transfer roll (30*b*) (T2=L2/N2), T3 (min) represents a running time of the fiber thread during which the fiber thread has run from just after the transfer roll (30*b*) to the transfer roll (30*c*) (T3=L3/N3), and T4 (min) represents a running time of the fiber thread during which the fiber thread has run from just after the transfer roll (30*c*) to the winder (18) (T4=L4/N4).

In other words, provided that Tn is a running time of the jointed portion (a) during which the jointed portion (a) has run a distance Kn (m) from the detection means (24), the position of the jointed portion (a) is located between the detection means (24) and just before the oxidization oven (10) when Tn<T1, the position of the jointed portion (a) is located between the oxidization oven (10) and the transfer roll (30*b*) when T1<Tn<T1+T2, the position of the jointed portion (a) is located between just after the transfer roll (30*b*) and the transfer roll (30*c*) when T1+T2<Tn<T1+T2+T3, and the position of the jointed portion (a) is located between just after the transfer roll (30*c*) and the winder (18) when T1+T2+T3<Tn<T.

Positional information of the jointed portion (a) (a distance Kn (m) from the detection means (24) that the jointed portion a has run) located between the detection means (24) and the winder (18) can be calculated by the following equations.

When Tn<T1:

$$Kn=L1\times Tn/T1$$

When T1<Tn<T1+T2:

$$Kn=L1+L2\times(Tn-T1)/T2$$

When T1+T2<Tn<T1+T2+T3:

$$Kn=L1+L2+L3\times(Tn-T1-T2)/T3$$

When T1+T2+T3<Tn<T:

$$Kn=L1+L2+L3+L4\times(Tn-T1-T2-T3)/T4$$

The control means (28) is a means for controlling the winder (18) in such a way that a carbon fiber thread (Z) including the jointed portion (a) and a carbon fiber thread (Z) not including the jointed portion (a) are separately wound up around different winding bobbins based on the positional information of the jointed portion (a) acquired by the positional information-acquisition means (26). In other words, the control means (28) is a means for controlling a cutting means in such a way that a carbon fiber thread (Z) is cut before and after the jointed portion (a) based on the positional information of the jointed portion (a) acquired by the positional information-acquisition means (26), and is also a means for controlling a switchover mechanism in such a way that a carbon fiber thread (Z) including the jointed portion (a) is wound up around the jointed portion-winding bobbin (22) and a carbon fiber thread (Z) not including the jointed portion (a) is wound up around the product-winding bobbin (20).

The control means (28) is not critical as long as it can control the winder (18) based on the positional information of the jointed portion (a).

The control means (28) may be constituted, for example, by goods on the market or by an exclusive hardware and software. In addition, peripheral equipment such as input device and display device may be connected to the control means (28), if necessary. Examples of the input device include a display touch panel, switch panel, and keyboard. Examples of the display device include a CRT (Cathode Ray Tube, Braun tube) and liquid crystal display.

The transfer rolls (30*a*), (30*b*), (30*c*), and (30*d*) are not critical as long as they can transfer the fiber thread, and conventional transfer rolls to be used for production of a carbon fiber thread can be used.

In addition, the supply boxes (32*a*) and (32*b*) are not critical as long as they can supply the carbon fiber thread precursor (X) to the production system (1), and for example, a box in which the carbon fiber thread precursor (X) is stored while being folded and piled up, can be used. In addition, the carbon fiber thread precursor (X) wound up around a winding bobbin instead of the supply boxes (32*a*) and (32*b*) may be supplied to the production system (1).

Note that the production system for a carbon fiber thread of the present invention is not limited to the system shown in FIG. 1. For example, the detection means (24) may be arranged at any position on the primary side of the winder (18), though the detection means (24) is provided on the primary side of the oxidization oven (10) in the production system (1) of the present embodiment. Arrangement of the detection means (24) may be determined in consideration of the relation between a distance from the detection means (24) to the winder (18) and an error of the positional information of the jointed portion (a) and in consideration of time necessary for a switchover of winding bobbins with the switchover mechanism of the winder (18). In addition, the production system may not be equipped with the surface treatment device (14) or the sizing treatment device (16).

The carbon fiber thread precursor (X) may be selected in accordance with the use, and for example, a carbon fiber thread precursor composed of a homopolymer of acrylonitrile or composed of an acrylonitrile polymer such as copolymer of acrylonitrile with another monomer can be recited.

<Production Method>

The production method for a carbon fiber thread of the present invention is a production method for a carbon fiber thread by continuously subjecting a carbon fiber thread precursor having a jointed portion connecting respective ends of two carbon fiber thread precursors to heat treatment, which comprises: a step (1) of detecting the jointed portion by a difference in thickness between the jointed portion and other portions; a step (2) of subjecting the carbon fiber thread precursor to heat treatment to obtain a carbon fiber thread; a step (3) of acquiring positional information concerning a position where the jointed portion is located between a position where the jointed portion has been detected and a position where the carbon fiber thread is wound up; a step (4) of cutting the carbon fiber thread before and after the jointed portion based on the positional information; and a step (5) of winding separately a carbon fiber thread including the jointed portion and a carbon fiber thread not including the jointed portion, both being made by the cutting.

Hereinafter, a production method for a carbon fiber thread by use of the production system (1) will be explained as one embodiment of the production method of the present invention.

Firstly, a jointed portion (a) is formed by connection of respective ends of two carbon fiber thread precursors stored in the supply boxes (32*a*) and (32*b*), respectively. In the embodiment of FIG. 1, a back end of the carbon fiber thread precursor (X) stored in the supply box (32*b*) and a front end of the carbon fiber thread precursor (X) stored in the supply box (32*a*) are connected and the jointed portion (a) is formed. Further, a back end of the carbon fiber thread precursor (X) stored in the supply box (32*a*) is to be connected with a front end of the carbon fiber thread precursor (X) stored in the succeeding supply box (not shown in the figure). By connecting respective ends of two carbon fiber thread precursors (X) in this manner, the carbon fiber thread precursor (X) is continuously supplied to the production system (1) and heat treatment is carried out.

Although the method for connecting respective ends of two carbon fiber thread precursors (X) is not particularly limited, it is preferable that the jointed portion (a) of the carbon fiber thread precursor (X) be oxidized with a view to preventing breakage of fibers caused by heat accumulation during heat treatment. In other words, it is preferable that the jointed portion (a) have an oxidized portion.

Figure 2:
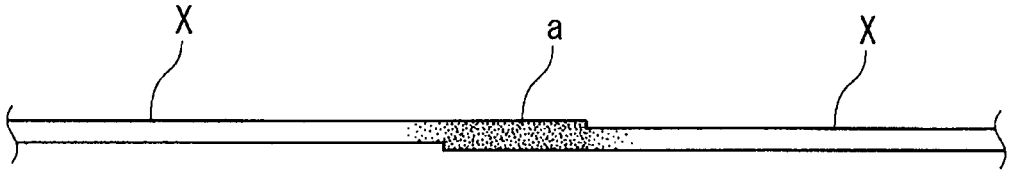
FIG. 2: A schematic front view showing one embodiment of a jointed portion of a carbon fiber thread precursor.

As a method for connecting respective ends of two carbon fiber thread precursors (X), a method of connecting the respective ends with at least one of the respective ends of two carbon fiber thread precursors (X) being oxidized and a method of connecting respective ends of two carbon fiber thread precursors (X) by use of another oxidized fiber thread can be recited, and the former is preferable, and it is more preferable to connect respective ends of two carbon fiber thread precursors (X) with both ends being oxidized as shown FIG. 2. As examples of the former method, Japanese Patent Application Laid-Open No. 2000-144,534 and Japanese Patent Application Laid-Open No. 2002-302,341 can be recited, and as an example of the latter method, Japanese Patent Application Laid-Open No. Hei 10-226,918 can be recited.

It is preferable that a ratio of the thickness D1 of the jointed portion (a) of the carbon fiber thread precursor (X) to the thickness D2 of other portions of the carbon fiber thread precursor (X), namely a ratio (D1/D2), be 2.0 to 6.0. When the ratio (D1/D2) is 2.0 or more, occurrence of mal-detection or non-detection of the jointed portion can be reduced. When the ratio (D1/D2) is 6.0 or less, occurrence of mal-detection of the jointed portion (a) caused by generation of fluff can be reduced.

It is preferable that the thickness of the carbon fiber thread precursor (X) be about 0.2 to 0.35 mm, and the thickness of the jointed portion (a) be 0.4 to 2.1 mm.

The carbon fiber thread precursor (X) having the jointed portion (a) is introduced into the oxidization oven (10) by the transfer roll (30*a*).

In the step (1), the jointed portion (a) is detected by the detection means (24) on the primary side of the transfer roll (30*a*). The detection of the jointed portion (a) by the detection means (24) is preferably carried out as follows: when the thickness corresponding to the jointed portion (a) is detected between 0.2 t to 1.0 t second, it is confirmed that the jointed portion (a) has passed through the detection means (24), provided that the time for the whole jointed portion (a) to pass through the detection means (24) is t (second). In this way, it becomes easy to prevent mal-detection of the jointed portion (a).

In the step (2), the carbon fiber thread precursor (X) is subjected to an oxidization treatment and the oxidized fiber thread (Y) is obtained, and then the oxidized fiber thread (Y) is introduced into the carbonization furnace (12) for carbonization by the transfer roll (30*c*) and the carbon fiber thread (Z) is obtained. In the step (2), a transfer velocity of the transfer roll (30*b*) and that of the transfer roll (30*c*) are set differently so that a tension of the fiber thread during the treatment in each of the oxidization oven (10) and the carbonization furnace (12) is kept at a proper value.

In addition, in the present embodiment, surface of the carbon fiber thread (Z) carbonized in the carbonization furnace (12) is subjected to a treatment by the surface treatment device (14), washed, and dried, and then a sizing agent is given to the carbon fiber thread (Z) by the sizing treatment device (16) and then dried.

In the step (3), positional information of the jointed portion (a) is acquired between a position where the jointed portion has been detected and a position where the carbon fiber thread is wound up, namely, between the detection means (24) and the winder (18). The acquisition of the positional information of the jointed portion (a) is carried out through calculation by use of the positional information-acquisition means (26).

In the step (4), the carbon fiber thread (Z) is cut before and after the jointed portion (a). Thus, the carbon fiber thread (Z) is separated into a carbon fiber thread (Z) including the jointed portion (a) and a carbon fiber thread (Z) not including the jointed portion (a). Cutting of the carbon fiber thread (Z) in the step (4) is carried out in such a way that the time taken for the jointed portion (a) to arrive at the winder (18) is determined through calculation by use of the positional information-acquisition means (26), and based on this time, the control means (28) controls cutting by the cutting means of the winder (18).

Cutting of the carbon fiber thread (Z) is preferably carried out at positions 25 to 50 m or more before and after the jointed portion (a). It becomes easy to prevent mixing of the jointed portion (a) and its surrounding portion where strength is lowered, by cutting the carbon fiber thread (Z) at positions 25 m or more before and after the jointed portion (a). In addition, it becomes easy to reduce the loss of the carbon fiber thread (Z) and thus to improve productivity, by cutting the carbon fiber thread (Z) at positions 50 m or less before and after the jointed portion (a).

In the step (5), the carbon fiber thread (Z) not including the jointed portion (a) is wound up around the product-winding bobbin (20) and the carbon fiber thread (Z) including the jointed portion (a) is wound up around the jointed portion-winding bobbin (22). Winding up of the carbon fiber thread (Z) in the step (5) is carried out, in the same manner as in cutting in the step (4), in such a way that the time taken for the jointed portion (a) to arrive at the winder (18) is determined through calculation by use of the positional information-acquisition means (26), and based on this time, the control means (28) controls a switchover mechanism of the winder (18) for switchover of the product-winding bobbin (20) and the jointed portion-winding bobbin (22).

Hereinafter, an example of a specific method of the step (4) and step (5) will be shown, but the present invention is not limited to this method.

The carbon fiber thread (Z) is wound up around the product-winding bobbin (20) without containing the jointed portion (a), and the product-winding bobbin (20) is moved to a waiting position while the jointed portion-winding bobbin (22) is moved to just before a winding-up position. At this time, a traverse section for a yarn guide (not shown in the figure) is changed, with the carbon fiber thread (Z) being not cut and kept in a connected state, and the carbon fiber thread (Z) is guided to a thread gripping device (not shown in the figure) and gripped. Subsequently, the yarn guide is returned to an ordinary traverse section, the carbon fiber thread (Z) is wound up around the jointed portion-winding bobbin (22), the carbon fiber thread (Z) across the product-winding bobbin (20) and the jointed portion-winding bobbin (22) is automatically cut by a cutting means, and winding up around the jointed portion-winding bobbin (22) is started.

Then, a fully loaded product-winding bobbin (20) is detached from the winder (18) and an empty product-winding bobbin (20) is newly installed, while the carbon fiber thread (Z) including the jointed portion (a) is wound up around the jointed portion-winding bobbin (22). Subsequently, the jointed portion-winding bobbin (22) is moved to the waiting position after the carbon fiber thread (Z) including the jointed portion (a) is wound up in a predetermined length, at the same time the product-winding bobbin (20) is moved to the winding up position, winding up of the product carbon fiber thread (Z) not including the jointed portion (a) is started, and the carbon fiber thread (Z) between the jointed portion-winding bobbin (22) and the product-winding bobbin (20) is cut by the cutting means.

As explained so far, according to the production system and the production method for a carbon fiber thread of the present invention, a carbon fiber thread precursor having a jointed portion connecting respective ends of two carbon fiber thread precursors is continuously subjected to heat treatment. In addition, a thus obtained carbon fiber thread can be cut before and after the jointed portion based on the positional information of the jointed portion obtained by a detection means, and a carbon fiber thread including the jointed portion and a carbon fiber thread not including the jointed portion can be separately wound up. Consequently, mal-detection or non-detection of the jointed portion caused by visual inspection can be prevented, a carbon fiber thread excellent in quality can be obtained, and a process ranging from heat treatment of a carbon fiber thread precursor to winding up of a carbon fiber thread can be automated. Therefore, a high quality carbon fiber thread can be produced with a high productivity and a low cost.

INDUSTRIAL APPLICABILITY

The production system and the production method for a carbon fiber thread of the present invention can produce a high quality carbon fiber thread with a high productivity and a low cost, and hence can be suitably used as a production system and a production method for a carbon fiber thread to be used in industry such as airplanes, sport goods, buildings, public works, and energy related fields.

EXPLANATION OF NUMERALS

1: Production system
10: Oxidization oven
12: Carbonization furnace
18: Winder
24: Detection means
26: Positional information-acquisition means
28: Control means

What is claimed is:

1. A production method for a carbon fiber thread by continuously subjecting a carbon fiber thread precursor having a jointed portion connecting respective ends of two carbon fiber thread precursors to heat treatment, the production method comprising steps of:

detecting the jointed portion by a difference in thickness between the jointed portion and other portions of the carbon fiber thread precursor;

subjecting the carbon fiber thread precursor, including the joined portion, to a heat treatment to obtain a carbon fiber thread;

acquiring positional information of a position where the jointed portion is located between a position where the jointed portion has been detected and a position where the carbon fiber thread is wound up on a winder;

determining a calculated time for the jointed portion to arrive at the winder based on the positional information;

cutting the carbon fiber thread before and after the jointed portion based on the calculated time; and winding separately a carbon fiber thread including the jointed portion and a carbon fiber thread not including the jointed portion, both being made by the cutting, the carbon fiber thread including the jointed portion and the carbon fiber thread not including the jointed portion being separately wound up around different winding bobbins such as a jointed portion-winding bobbin and a product-winding bobbin.

2. The production method of claim 1, further comprising subjecting the carbon fiber thread precursor, including the joined portion, to an oxidation treatment prior to subjecting the carbon fiber thread precursor to the heat treatment.

3. The production method of claim 1, further comprising subjecting the carbon fiber thread precursor, including the joined portion, to a surface treatment after subjecting the carbon fiber thread precursor to the heat treatment.

4. The production method of claim 1, further comprising subjecting the carbon fiber thread precursor, including the joined portion, to a sizing treatment after subjecting the carbon fiber thread precursor to the heat treatment.

5. The production method of claim 1, wherein the steps of the cutting and the winding further include:

winding up the carbon fiber thread, not including the jointed portion, around the product-winding bobbin, prior to the cutting;

moving the product-winding bobbin to a waiting position;

moving the jointed portion-winding bobbin to a winding-up position;

winding up, at least partially, the carbon fiber thread, including the jointed portion, around the jointed portion-winding bobbin;

cutting the carbon fiber thread located between the product-winding bobbin and the jointed portion-winding bobbin; and winding up, to a predetermined length, the carbon fiber thread, including the jointed portion, around the jointed portion-winding bobbin.

6. The production method of claim 5, further comprising removing the product-winding bobbin and installing an empty product-winding bobbin while winding up the carbon fiber thread, including the jointed portion, around the jointed portion-winding bobbin to the predetermined length.

7. The production method of claim 6, further comprising moving the jointed portion-winding bobbin to the waiting position after the carbon fiber thread, including the jointed portion, after the jointed portion-winding bobbin has been wound up to the predetermined length.

8. The production method of claim 7, further comprising moving the empty product-winding bobbin to the winding-up position while the jointed portion-winding bobbin is being moved to the waiting position.

9. The production method of claim 1, wherein the cutting is performed on the carbon fiber thread at positions 50 m or less before and after the jointed portion.

10. The production method of claim 1, wherein the cutting is performed on the carbon fiber thread at positions 25 to 50 m before and after the jointed portion.

11. The production method of claim 1, wherein the jointed portion has a thickness that is 2.0 to 6.0 times thicker than the other portions of the carbon fiber thread precursor.

12. The production method of claim 1, wherein a thickness of the jointed portion is between 0.4 to 2.1 mm.

13. The production method of claim 1, wherein a thickness of the other portions of the carbon fiber thread precursor is between 0.2 to 0.35 mm.

* * * * *